United States Patent [19]

Gotou et al.

[11] Patent Number: 4,921,164

[45] Date of Patent: May 1, 1990

[54] CENTRAL AIR CONDITIONING SYSTEM WITH DAMPER AND METHOD FOR CONTROLLING THE SAME

[75] Inventors: Yukifumi Gotou; Hidetoshi Narikiyo; Yoshihiro Chuma, all of Fuji, Japan

[73] Assignee: Kabushiki Kaisha Toshiba, Kawasaki, Japan

[21] Appl. No.: 350,892

[22] Filed: May 12, 1989

[30] Foreign Application Priority Data

Sep. 14, 1988 [JP] Japan ..... 63-230961

[51] Int. Cl.[5] ..... F24F 7/00

[52] U.S. Cl. ..... 236/49.3; 137/624.18

[58] Field of Search ..... 236/11, 49.3; 137/624.18

[56] References Cited

U.S. PATENT DOCUMENTS 3,814,173 6/1974 Coon ..... 165/22 X 4,635,445 1/1987 Otsuka et al. ..... 236/49.3 X

FOREIGN PATENT DOCUMENTS 60-47497 10/1985 Japan .

62-69746 5/1987 Japan .

*Primary Examiner*—William E. Wayner

*Attorney, Agent, or Firm*—Cushman, Darby & Cushman

[57] ABSTRACT

A rapid increase in the static pressure in the air duct which occurs while the damper is moving to the fully closed position is avoided by maintaining the damper at a preclosed position between fully opened and fully closed positions for a prescribed period and by simultaneously reducing the amount of conditioned air supplied to the air duct while the damper is positioned at the pre-closed position to regulate the static pressure in the air duct to a desirable level. Thus, air leakage noise which occurs in the air duct when the static pressure in the air duct rapidly increases for a short time can be avoided.

6 Claims, 3 Drawing Sheets

CENTRAL AIR CONDITIONING SYSTEM WITH DAMPER AND METHOD FOR CONTROLLING THE SAME

BACKGROUND OF THE INVENTION

1. Field of the Invention

This invention relates, in general, to air conditioning systems. In particular, the invention relates to a central air conditioning system wherein the air-conditioning to a plurality of rooms is simultaneously carried out through a duct and a plurality of dampers by one central air conditioning apparatus.

2. Description of the Related Art

A conventional air conditioning system typically includes one heat source unit and a duct which is in communication with a plurality of rooms to be air-conditioned to simultaneously control the temperature in the plurality of rooms. The conventional air conditioning system usually is provided with an automatic air volume control function, i.e., a so-called VAV (variable air volume) system. In the VAV system, a damper and an air volume sensor are arranged in the diverging path formed between the duct and each room, and the opening degree of each damper is controlled on the basis of the air conditioning load of the corresponding room. Thus, the flow rate of air fed from the heat source unit to each room is controlled by the operation of the corresponding damper. The volume of air fed from the heat source unit also is controlled in accordance with the total air conditioning load of each room.

In the above-described conventional air conditioning system including the VAV system, the damper is closed to stop the air flow supplied from the heat source unit to the corresponding room when the air conditioning load of the corresponding room approaches zero. At this time, an air leakage noise occurs in the duct and is audible in the room. Thus, such air leakage noise causes an annoyance to people in the room. The air leakage noise occurs at a gap between the damper and the duct when the damper is closed. This is because the volume of air supplied from the heat source unit creates a relatively large temporary increase in the static pressure in the duct, as shown in FIG. 1. The noise continues until the volume of air in the duct gradually reduces to a point whrere the static pressure correspondes to the modified air conditioning load.

SUMMARY OF THE INVENTION

Accordingly, it is an object of the present invention to reduce air leakage noise occuring while the damper is moving to a closed position in a central air conditioning system.

To accomplish the above object, a central air conditioning system includes an air conditioning device for conditioning air from a source thereof, a duct of channelling the conditioned air from the conditioning device to a plurality of outlets, and a forcing device for forcing the conditioned air through the duct and generating a static pressure in the duct. The air conditioning system further includes a damper, corresponding to each outlet, which is movable between an open position where the conditioned air flows through the outlet and a closed position wherein the flow of conditioned air through the outlet is interrupted for regulating the flow of conditioned air through the outlet, and a pre-closing control device for automatically reducing a rapid change in the static pressure in the duct while each damper is moving to the closed position.

The pre-closing control device may include a controlling device for controlling the forcing device to decrease the amount of the conditioned air fed from the air conditioning device to the duct and to regulate the static pressure in the duct to a desirable level while each damper is moving to the closed position. The pre-closing control device may also include a plurality of air volume sensors for respectively detecting the amount of the conditioned air flowing through the corresponding outlet. Thus, the forcing device is controlled on the basis of the detection results of the air volume sensors.

BRIEF DESCRIPTION OF THE DRAWINGS

These and other objects and advantages of this invention will become more apparant and more readily appreciated from the following detailed description of the presently preferred exemplary embodiment of the invention, taken in conjunction with the accompanying drawings, wherein like reference numerals throughout the various figures denote like structural elements and wherein.

DETAILED DESCRIPTION OF THE PREFERRED EMBODIMENT

The preferred embodiment of the present invention will be described in more detail with reference to the accompanying drawings.

Figure 1:
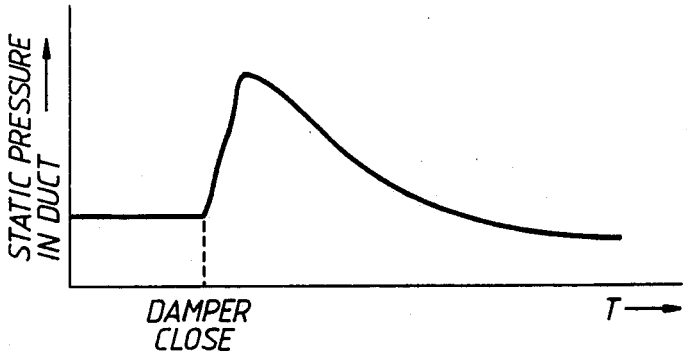
Fig. 1. PRIOR ART
FIG. 1 is a graph illustrating transition of static pressure in the duct of a conventional central air conditioning system while a damper is moving to the closed position.
Figure 2:
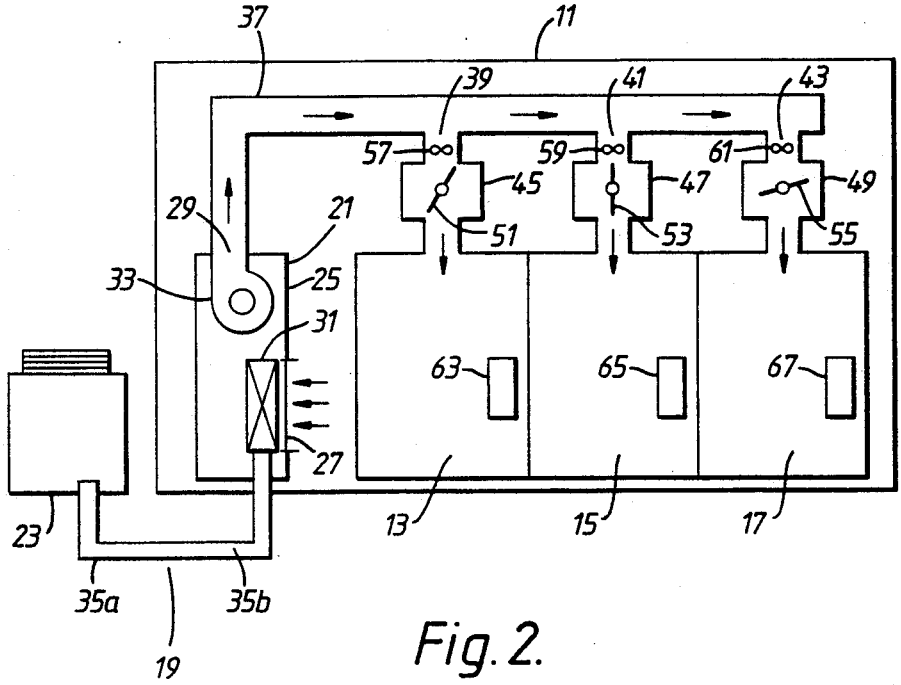
FIG. 2 is a schematic view illustrating a central air conditioning system of one embodiment of the present invention.

As shown in FIG. 2, a house structure 11 includes first, second and third chambers 13, 15 and 17. A heat source unit 19 includes an internal unit 21 disposed in house structure 11 and an external unit 23 arranged outside house structure 11. Internal unit 21 includes a casing 25 wherein an intake opening 27 is formed in the side wall thereof and a discharge opening 29 is formed in the upper wall thereof. An internal heat exchanger 31 is arranged at the inside of casing 25 opposite to intake opening 27. An internal fan casing 33 also is attached to the upper wall of casing 25 to be in communication with discharge opening 29. A fan and a fan driving motor 81 shown in FIG. 3, which are used in a conventional fan device, are housed in fan casing 29. External unit 23 includes a compressor, an external heat exchanger, etc., which are also used in a conventional external unit, and therefore, those compornents are not shown in FIG. 2. It should be noted that refrigerant is circulated between the compressor arranged in external unit 23 and internal heat exchanger 31 disposed in internal unit 21 through a pair of refrigerant pipes 35*a* and 35*b* to perform a refrigerating cycle.

As shown in FIG. 2, one end of a duct 37 is in communication with discharge opening 29, and the other end thereof is closed. A plurality of diverging openings 39, 41, 43 are formed in the portions of duct 37 corresponding to first, second and third chambers 13, 15 and 17. A plurality of terminal units 45, 47 and 49 are connected between the plurality of diverging openings 39, 41, 43 of duct 37 and first, second and third chambers 13, 15 and 17 to supply air from internal unit 21 to each chamber 13, 15, 17. Each terminal unit 45, 47, 49 includes a damper 51, 53, 55 disposed in the pass thereof to control the flow of air fed from internal unit 21 to each chamber 13, 15, 17. The opening degree of each damper 51, 53, 55 is controlled by a motor (not shown) between the fully opened position and the fully closed position. However, in a practical operation, a flow of air fed from internal unit 21 is controlled between the fully opened position and a minimum opened position of the damper the opening degree of which is fourty or fifty percent of its fully opened degree (fully opened position). A flow of air fed from internal unit 21 is not substantially controlled between the minimum opened position and the fully closed position of the damper.

Terminal units 45, 47 and 49 respectively include an air volume sensor 57, 59, 61 to detect the amount of air fed from internal unit 21 to each chamber 13, 15, 17 through duct 37. Chambers 13, 15 and 17 are respectively provided with a remote control unit 63, 65, 67. Thus, the temperature in each chamber 13, 15, 17 is controlled by heat source unit 19 to a desired condition through the corresponding control units 63, 65 and 67.

Figure 3:
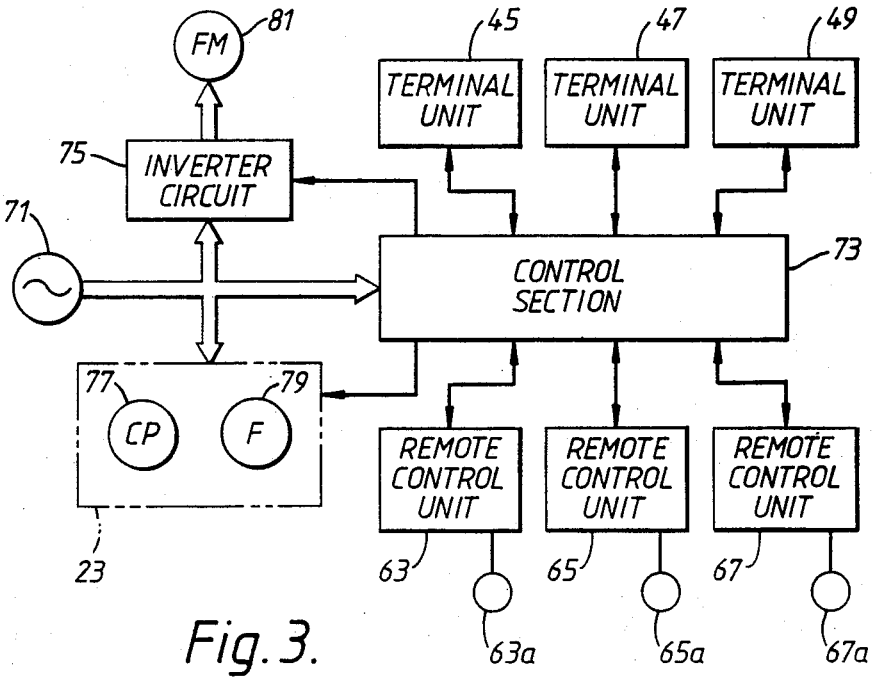
FIG. 3 is a block diagram illustrating a control arrangement of the central air conditioning system shown in FIG. 2.

The control circuit of the above-described central air conditioning system will now be described. As shown in FIG. 3, an AC voltage fed from AC power source 71 is supplied to a control section 73, an inverter circuit 75 and electric components of external unit 23, e.g., compressor 77, external fan motor 79, etc. Control section 73 includes a microcomputer and its peripheral circuits to control the operation of the air conditioning system shown in FIG. 2. Terminal units 45, 47 and 49 shown in FIG. 2 are respectively connected to control section 73. Each remote control unit 63, 65, 67 also is connected to control section 73. Inverter circuit 75 is connected to control section 73. Inverter circuit 75 rectifys the AC voltage fed from AC power source 71 and inverts the rectified voltage into an AC voltage of a prescribed frequency by the switching operation responding to the command signal fed from control section 73. Thus, inverter circuit 75 supplies an AC voltage of a prescribed frequency to internal fan motor 81, disposed in internal fan casing 33 of internal unit 21, to control the rotation speed of internal fan motor 81. As shown in FIGURE 3, remote control sections 63, 65 and 67 respectively include an internal temperature sensor 63*a*, 65*a*, 67*a* and transmit the temperature data detected by sensors 63*a*, 65*a* and 67*a* to control section 73. Control section 73 includes an air amount control function wherein the amount of air fed from internal unit 21 is controlled in accordance with total air conditioning load of each chamber 13, 15, 17, and a damper control function wherein the degree of opening of each damper 51, 53, 55 is controlled on the basis of the air conditioning load of the corresponding chambers 13, 15 and 17. Control section 73 also includes a closing control function wherein a damper to be closed is moved toward the fully closed position and is maintained at a prescribed opening degree for a prescribed period before the damper is positioned at the fully closed position.

The operation of the above-described air conditioning system will be described.

Desired room temperatures are respectively set to control section 73 through each remote control unit 63, 65, 67, and a start/stop switch (not shown) in each remote control unit 63, 65, 67 is operated. An operation mode, e.g., cooling operation, also is set in control section 73 before the start/stop switch is operated. Control section 73 drives internal and external units 21 and 23 when one of the start/stop switches is operated. At this time, start/stop switches of all remote control units 63, 65 and 67 are not always operated. However, in this case, the operation of this system will be described on the assumption that all start/stop switches are operated. When external unit 23 is operated, a cooling cycle is performed and internal heat exchanger 31 operates as an evaporator. Refrigerant is supplied from external unit 23 to internal heat exchanger 31 through refrigerant pipe 35*b*. Air in house structure 11 is taken into internal unit 21 through intake opening 27 by a fan (not shown) in fan casing 33. Thus, intaken air is cooled by internal heat exchanger 31 and is forcibly supplied to each chamber 13, 15, 17 through duct 37 and the corresponding terminal units 45, 47 and 49. Thus, a static pressure is generated in duct 37.

Figure 4:
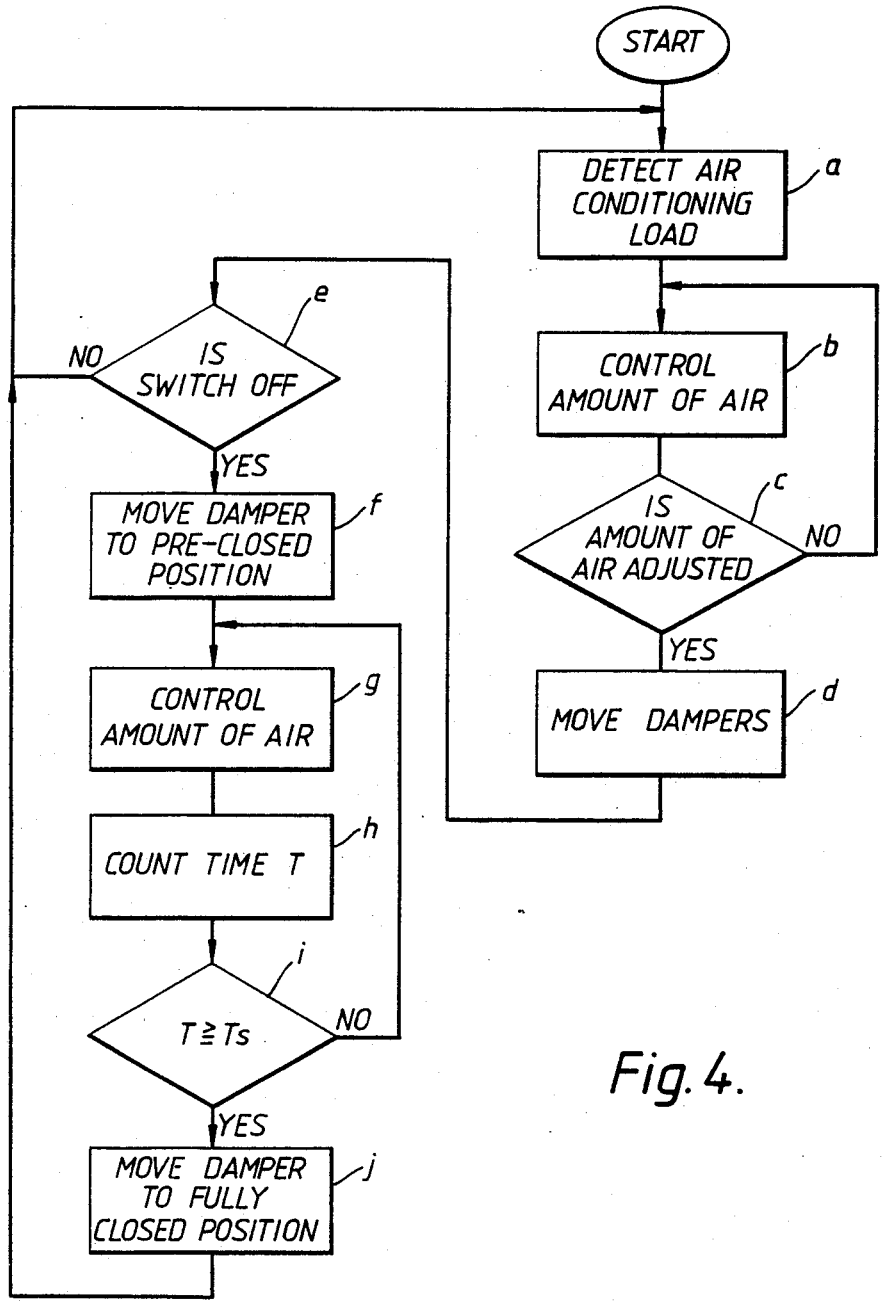
FIG. 4 is a flow chart illustrating the operation of the control arrangement shown in FIG. 3.

As shown in FIG. 4, in the above-described initial stage of the cooling operation, control section 73 detects the air conditioning load of each chamber 13, 15, 17 through temperature sensor 63*a*, 65*a*, 67*a* of the corresponding remote control unit 63, 65, 67 (step a). It should be noted that the air conditioning load is a difference between the detected temperature of each chamber 13, 15, 17 and the corresponding set temperatures. Control section 73 controls the output frequency of inverter circuit 75 on the basis of the total air conditioning load detected. The rotation speed of internal fan motor 81 is controlled by inverter circuit 75 and thus, the amount of air discharged from internal unit 21 to duct 37 is controlled at a desirable value (step b). At this time, air volume sensors 57, 59 and 61 respectively detect the amount of air fed to chambers 13, 15 and 17 through dampers 51, 53 and 55, and the detection results are transmitted to control section 73 therefrom to control internal fan motor 81 properly. In step c, if the amount of air fed to duct 37 is not adjusted to the desirable value, NO pass is taken, and the step b is further executed. However, if the amount of air fed to duct 37 is the desirable value, YES pass is taken in step c. In step d, the degree of opening of each damper 51, 53, 55 of terminal units 45, 47 and 49 is controlled in response to the air conditioning load in the corresponding chambers 13, 15 and 17. For example, if the temperature in chamber 13 is high, damper 51 is further controlled toward its fully opened position resulting in the increase in the flow of air supplied to chamber 13. On the contrary, if the temperature in chamber 13 is low, damper 51 is controlled toward its minimum opened position. Thus, the flow of air supplied to chamber 13 is decreased. Dampers 53 and 55 are also controlled as similar to damper 51 described above. In step e, the start/stop switches (not shown) of remote control units 63, 65 and 67 are respectively detected whether or not each start/stop switch is operated to OFF state. If the start/stop switches have been ON state, the NO pass is taken. Otherwise, the YES pass is taken. If the NO pass is taken in step e, the above-described steps a, b, c and d are repeatedly executed.

During the above-described operation, if the temperature detected by sensor 65*a* decreases below the set temperature even after the degree of opening of damper 53 is controlled to the minimum opened position, the start/stop switch of remote control unit 65 is operated to OFF state. Therefore, the YES pass is taken in step e. In step f, damper 53 is controlled to a pre-closed position which locates between the minimum opened position and the fully closed position. In the pre-closed position, the degree of opening of damper 53 is set at 10% or 20% of that of the fully opened position. After damper 53 is positioned at the pre-closed position, the rotation speed of internal fan motor 81 is controlled to reduce the amount of air supplied from internal unit 21 to duct 37 in step g, thus, the static pressure in duct 37 is regulated. In step h, a timer (not shown) in control section 73 measures the time T for which damper 53 is maintained at the pre-closed position. The counting time T of the timer is compared with a prescribed time Ts in step i. If the time T is not greater than the prescribed time Ts, the NO pass is taken, and steps g and h are reexecuted. Otherwise, the YES pass is taken in step i, and Damper 53 is moved to the fully closed position in step j. In this case, the prescribed time Ts is selected from the range of five to twenty minutes, which depends on the air blowing ability of the internal fan device (internal fan motor 81).

Since the degree of opening of the damper is maintained at a very limited level, e.g., 10% or 20% of that in fully opened state, when the damper is at the pre-closed position, the temperature in the corresponding chamber does not decrease overly.

Figure 5:
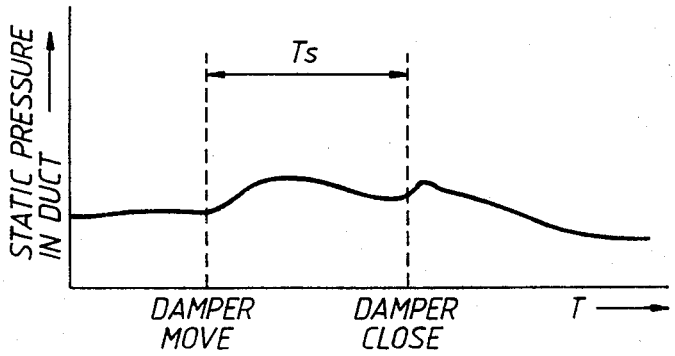
FIG. 5 is a graph illustrating transition of a static pressure in the duct of the central air conditioning system shown in FIG. 2 while the damper is moving to the closed position in accordance with the operation shown in FIG. 4.

According to the above-described embodiment, since damper 53 is positioned at the pre-closed position for the prescribed time Ts before damper 53 is closed, and the amount of air supplied from internal unit 21 to duct 37 is reduced during the prescribed time Ts, a rapid increase in the static pressure in duct 37 is controlled to a suitable level which corresponds to the modified total air conditioning load, as shown in FIG. 5. Increase in the static pressure in duct 37 is minimized when damper 53 is closed after damper 53 is positioned at the pre-closed position for the prescribed time Ts. Thus, the air leakage noise caused by the closing operation of damper 53 in terminal unit 47 can be avoided.

In the above-described embodiment, damper 53 is automatically maintained at the pre-closed position for a relatively long fixed time Ts even if the amount of air supplied from internal unit 21 to duct 37 has been reduced to a desirable level. However, the decrease in the amount of the air fed to the chamber where the damper is positioned at the pre-closed position may be detected by the corresponding air volume sensor, and the detection result of the air volume sensor is transmitted to the control section to control the rotation speed of the internal fan device precisely. In this case, the damper may be moved to the fully closed position immediately after the detection result of the corresponding air volume sensor is satisfied, and thus, a rapid increase in the static pressure in the duct can also be avoided. The above-described embodiment is described with regard to the cooling operation. However, the present invention may also be applied to a heating operation.

The present invention has been described with respect to a specific embodiment. However, other embodiments based on the principles of the present invention should be obvious to those of ordinary skill in the art. Such embodiments are intended to be covered by the claims.

What is claimed is:

1. A central air conditioning system for supplying conditioned air to a plurality of outlets, comprising:

means for conditioning air from a source thereof;

duct means for channelling the conditioned air from the conditioning means to the plurality of outlets, including means for forcing the conditioned air through the duct means and generating a status pressure in the duct means;

a damper corresponding to each outlet, movable between an open position wherein the conditioned air flows through the outlet and a closed position wherein the flow of conditioned air through the outlet is interrupted, for regulating the flow of conditioned air through the outlet, movement of each damper to the closed position causing changes in the static pressure in the duct means; and pre-closing control means for automatically reducing the change in the static pressure in the duct means while each damper is moving to the closed position, wherein each damper includes a pre-closed position between the open and closed positions, and the pre-closing control means includes means for maintaining each damper at the pre-closed position for a prescribed time before each damper moves to the closed position and means for reducing the amount of the conditioned air forced from the conditioning means to the duct means when each damper is positioned at the pre-closed position for regulating the static pressure in the duct means to a desirable level.

2. A system according to claim 1 wherein the pre-closing control means also includes a plurality of air volume sensors for respectively detecting the amount of the conditioned air flowing through the corresponding outlet, the forcing means being controlled on the basis of the detection results of the air volume sensors.

3. A system according to claim 1 further including a plurality of defined spaces, one of the spaces corresponding to each outlet, and an operating unit in each of the defined spaces.

4. A system according to claim 3, wherein the operating unit includes a temperature sensor for detecting the temperature in the corresponding defined space, each damper being controlled in accordance with the detection result of the temperature sensor.

5. A system according to claim 1, wherein the duct means includes an air duct having one open end, and the forcing means includes an internal unit having a fan device which is in communication with the open end of the air duct of the duct means for supplying the conditioned air to the plurality of outlet through the air duct.

6. A method for controlling a central air conditioning system including an internal unit for supplying conditioned air, and a damper having an open position, a closed position and a pre-closed position between the open and the closed positions, comprising the steps of:

moving the damper to the pre-closed position in response to a damper closing signal from a system control unit;

maintaining the damper at the pre-closed position for a prescribed time Ts;

reducing the amount of the conditioned air supplied from the internal unit; and moving the damper to the closed position after the prescribed time Ts has passed.

* * * * *